US007556161B2

(12) United States Patent
Shan et al.

(10) Patent No.: US 7,556,161 B2
(45) **Date of Patent: *Jul. 7, 2009**

(54) LIFTING MACHINERY OF TWO REEL DIFFERENTIAL TYPE FOR TWO 40 FEET CONTAINER SHORE CRANE

(75) Inventors: Jianguo Shan, Shanghai (CN); Baohua Zhang, Shanghai (CN)

(73) Assignee: Shanghai Zhenhua Port Machinery Co., Ltd., Shanghai (CN)

( * ) Notice: Subject to any disclaimer, the term of this patent is extended or adjusted under 35 U.S.C. 154(b) by 361 days.

This patent is subject to a terminal disclaimer.

(21) Appl. No.: 11/376,624

(22) Filed: Mar. 15, 2006

(65) Prior Publication Data

US 2006/0247085 A1 Nov. 2, 2006

(30) Foreign Application Priority Data

Apr. 6, 2005 (CN) ..... 2005 1 0024904

(51) Int. Cl.
*B66C 13/04* (2006.01)

(52) U.S. Cl. ..... 212/274; 212/326

(58) Field of Classification Search ..... 212/274, 212/326

See application file for complete search history.

(56) References Cited

U.S. PATENT DOCUMENTS

| | | | |
|---|---|---|---|
| 3,704,796 | A | 12/1972 | Dedons et al. |
| 3,807,582 | A | 4/1974 | Anderson |
| 3,812,987 | A | 5/1974 | Watatani |
| 3,837,503 | A | 9/1974 | Komatsu |

(Continued)

FOREIGN PATENT DOCUMENTS

| | | |
|---|---|---|
| CN | 2 225 462 | 4/1996 |

(Continued)

OTHER PUBLICATIONS

Office Action mailed on Nov. 13, 2007 and received in the co-pending U.S. Appl. No. 11/360,463, filed Feb. 23, 2006.

*Primary Examiner*—Thomas J Brahan
(74) *Attorney, Agent, or Firm*—Dorsey & Whitney LLP

(57) ABSTRACT

The invention relates to a lifting machinery of two reel differential type for two 40 feet container shore crane, comprising: a motor, a reductor and its high speed brake, reels and reel brakes; wherein at least one motor is provided; a planetary differential reductor is used as the reductor connected to the motor output end, the planetary differential reductor has a high speed input shaft, a low speed output shaft and a differential project shaft; the high speed input shaft connects to the motor output shaft, at least one high speed brake is provided on the high speed input shaft; two four project rope reels connect to two low speed output shaft; at least one reel brake is provided on each reel; and the lifting machinery comprises a differential shaft brake consisting of at least two differential shaft brakes provided on two differential project shaft; the revolution of the two differential project shaft of the planetary differential reductor is controlled by the two differential shaft brakes so that power of the planetary differential reductor may be distributed so as to achieve the synchronous operation of two hanger tools or the operation of single hanger tool, meeting the loading and unloading requirement, increasing the loading and unloading efficiency of the container crane by more than 60%.

6 Claims, 2 Drawing Sheets

U.S. PATENT DOCUMENTS

| | | | |
|---|---|---|---|
| 3,888,536 | A | 6/1975 | Durenec |
| 4,035,010 | A | 7/1977 | Kawashita et al. |
| 4,244,615 | A | 1/1981 | Brown |
| 4,563,030 | A | 1/1986 | Makino et al. |
| 5,039,275 | A | 8/1991 | Ide |
| 5,183,305 | A | 2/1993 | Nordstrom et al. |
| 5,671,912 | A | 9/1997 | Langford et al. |
| 5,718,550 | A | 2/1998 | Lanigan et al. |
| 5,775,866 | A | 7/1998 | Tax et al. |
| 5,871,249 | A | 2/1999 | Williams |
| 5,923,270 | A | 7/1999 | Sampo et al. |
| 5,951,226 | A | 9/1999 | Fantuzzi |
| 6,145,680 | A | 11/2000 | Jussila et al. |
| 6,312,213 | B1 | 11/2001 | Stinis |
| 6,354,782 | B1 | 3/2002 | Barry |
| 6,602,036 | B2 | 8/2003 | Takehara et al. |
| 6,698,990 | B1 | 3/2004 | Dobner et al. |
| 6,715,977 | B2 | 4/2004 | Dobner et al. |
| 6,920,963 | B2 | 7/2005 | Faller |
| 7,032,763 | B1 | 4/2006 | Zakula, Sr. et al. |
| 2003/0168871 | A1 | 9/2003 | Geis |
| 2003/0189348 | A1 | 10/2003 | Lindstrom |
| 2004/0032140 | A1 | 2/2004 | Solstad |
| 2006/0043748 | A1 | 3/2006 | Stinis et al. |

FOREIGN PATENT DOCUMENTS

| | | | |
|---|---|---|---|
| CN | 1155664 | | 7/1997 |
| CN | 2373421 | | 4/2000 |
| CN | 1 415 529 | | 5/2003 |
| CN | 1 448 331 | | 10/2003 |
| CN | 2 599 327 | | 1/2004 |
| CN | 2 628 508 | Y | 7/2004 |
| CN | 1 579 916 | | 2/2005 |
| DE | 12 74 299 | B | 8/1968 |
| DE | 38 38 058 | A1 | 5/1990 |
| EP | 1 650 156 | A | 5/1990 |
| FR | 828297 | A | 5/1938 |
| GB | 876647 | | 9/1961 |
| JP | 55-035722 | A | 3/1980 |
| JP | 9-267987 | | 10/1997 |
| JP | 10-324493 | | 12/1998 |
| JP | 2001/240372 | A | 9/2001 |
| JP | 2002068481 | A | 3/2002 |
| JP | 8 175784 | A | 4/2006 |
| WO | WO 98/34127 | | 8/1998 |
| WO | WO 01/58797 | A1 | 8/2001 |
| WO | WO 01/98195 | A1 | 12/2001 |
| WO | WO 2005/009885 | A1 | 2/2005 |

LIFTING MACHINERY OF TWO REEL DIFFERENTIAL TYPE FOR TWO 40 FEET CONTAINER SHORE CRANE

CROSS-REFERENCE TO RELATED APPLICATION

This application claims priority to Chinese patent application 200510024904.9, filed 6 Apr. 2005, the subject matter of which are hereby incorporated by reference in its entirety.

FIELD OF INVENTION

The invention generally relates to a lifting machinery for crane, more particularly, relates to a lifting machinery of two reel differential type for two 40 feet container shore crane.

BACKGROUND OF INVENTION

The increasing requirements of container transportation in the world and the continuous increment of the handling capacity of the container port put forward new and increased demands on the technical equipment for loading and unloading containers, and an urgent need for the design and development of high efficient bank-run container load and unload systems to meet the demand of the lifter productivity needed by the larger ships.

The main lifting machinery of the crane of the prior art carries out the lifting and lowering operation of one hanger tool only, hence only one 40 feet container or two 20 feet containers can be lifted at a time so that limits the production efficiency and does not meet the market requirement.

SUMMARY OF INVENTION

As one aspect of the invention, a lifting machinery for two reel differential type for two 40 feet container shore crane is provided so that the lifting machinery of a set of motors and reductors can lift two 40 or 45 feet containers (or four 20 feet containers) simultaneously, the lifting machinery may achieve the synchronous operation of two hanger tools or the operation of single hanger tool, increasing the loading and unloading efficiency by more than 60%, meeting the requirement of the increasing demand on loading and unloading efficiency of the ship transportation industry.

According to the invention, a lifting machinery of two reel differential type for two 40 feet container shore crane, comprising: a motor; a reductor and a high speed brake, said reductor connects to the motor; a reel provided on the output end of the reductor; and a reel brake connects to the reel; wherein, at least one motor is provided; said reductor is a planetary differential reductor connects to the output end of the motor, said planetary differential reductor has a high speed input shaft, a low speed output shaft and a differential project shaft controlling power distribution; the output shaft of said motor connects to the high speed input shaft of the planetary differential reductor, at least one high speed brake is provided on the high speed input shaft of the planetary differential reductor; said reel comprises a land side reel and sea side reel the two reels connect to the two speed output shafts of the planetary differential reductor, respectively; at least one reel brake is provided on each reel; and a differential shaft brake controlling the power distribution of the planetary differential reductor, said differential shaft brake connects to the differential project shaft of the planetary differential reductor.

According to one embodiment of the invention, said land side reel and/or said sea side reel is a four project rope reel having four project ropes; wherein said land side four project rope reel connects to the land side low speed output shaft of the planetary differential reductor, the four project ropes of the land side four project rope reel connects to a hanger tool; and said sea side four project rope reel connects to the sea side low speed output shaft of the planetary differential reductor, the four project ropes of the sea side four project rope reel connect to another hanger tool.

According to one embodiment of the invention, two motors are provided, one is the first motor and the other is the second motor; the output end of the first motor connects to a high speed input shaft of the planetary differential reductor, two high speed brakes are provided on said high speed input shaft of the planetary differential reductor; and the output end of the second motor connects to another high speed input shaft of the planetary differential reductor, two high speed brakes are provided on the high speed input shaft of the planetary differential redactor.

According to one embodiment of the invention, one motor is provided as the motor, the output end of the motor connects to a high speed input shaft of the planetary differential reductor; two high speed brake are provided on the high speed input shaft of the planetary differential reductor.

According to one embodiment of the invention, two reel brakes are provided on said land side four project rope reel; and two reel brakes are provided on said sea side four project rope reel.

According to one embodiment of the invention, said differential shaft brake has a first differential shaft brake and a second differential shaft brake controlling the power distribution of the planetary differential reductor, the two differential shaft brakes connect to two differential project shaft of the planetary differential reductor, respectively.

Compared with the prior art, the lifting machinery of two reel differential type for two 40 feet container shore crane according to the invention has the following advantages and benefits:

1. The present invention uses a planetary differential reductor having two side outputs in stead of the reductor of the prior art, according to the present invention, a set of motors and reductors connect to two sets of lifting machineries to distribute the power to the reels by actual outer moment using the planetary differential redactor, so as to achieve the synchronous operation of two hanger tools, such as two 40 or 45 feet containers (or four 20 feet containers) simultaneously, increasing the landing and unloading efficiency of the container shore crane by more than 60%;

2. The invention uses a planetary differential reductor and two differential shaft brakes provided on the differential project shaft of the planetary differential reductor. By controlling the differential project shaft by using the two differential shaft brakes, the synchronous operation of two hanger tools or the operation of single hanger tool can be carried out in order to meet the requirement of the landing and unloading; for example, if all of the differential shaft brakes are in the close state and all of the reel brakes are in the open state, the power is distributed to each reel according to the actual outer twisting moment automatically so that the synchronous operation of two hanger tools is carried out;

if one differential shaft brake is in the close state and another differential shaft brake is in the open state, the revolution of the respective differential project shaft of the planetary differential reductor is restrained by the differential shaft brake in the close state, then the twisting moment is transferred onto the reel at a respective side, and the twisting moment is not transferred onto the reel at another side since the differential project shaft in the open state in not constrained, so shat the operation of single hanger tool can be carried out;

3. A set of the planetary differential reductor is used to drive two sets of the lift machineries, thus the amount of the equipment such as motors, actuators (reductors) etc, can be decreased, simplifying the structure, reducing the weight and facilitating the maintenance.

BRIEF DESCRIPTION OF DRAWINGS

The object, detailed structure, features and advantages of the invention may be further understood from the following descriptions of the embodiments of the accompanying with the drawings, in which.

DETAILED DESCRIPTION OF PREFERRED EMBODIMENTS

Figure 1:
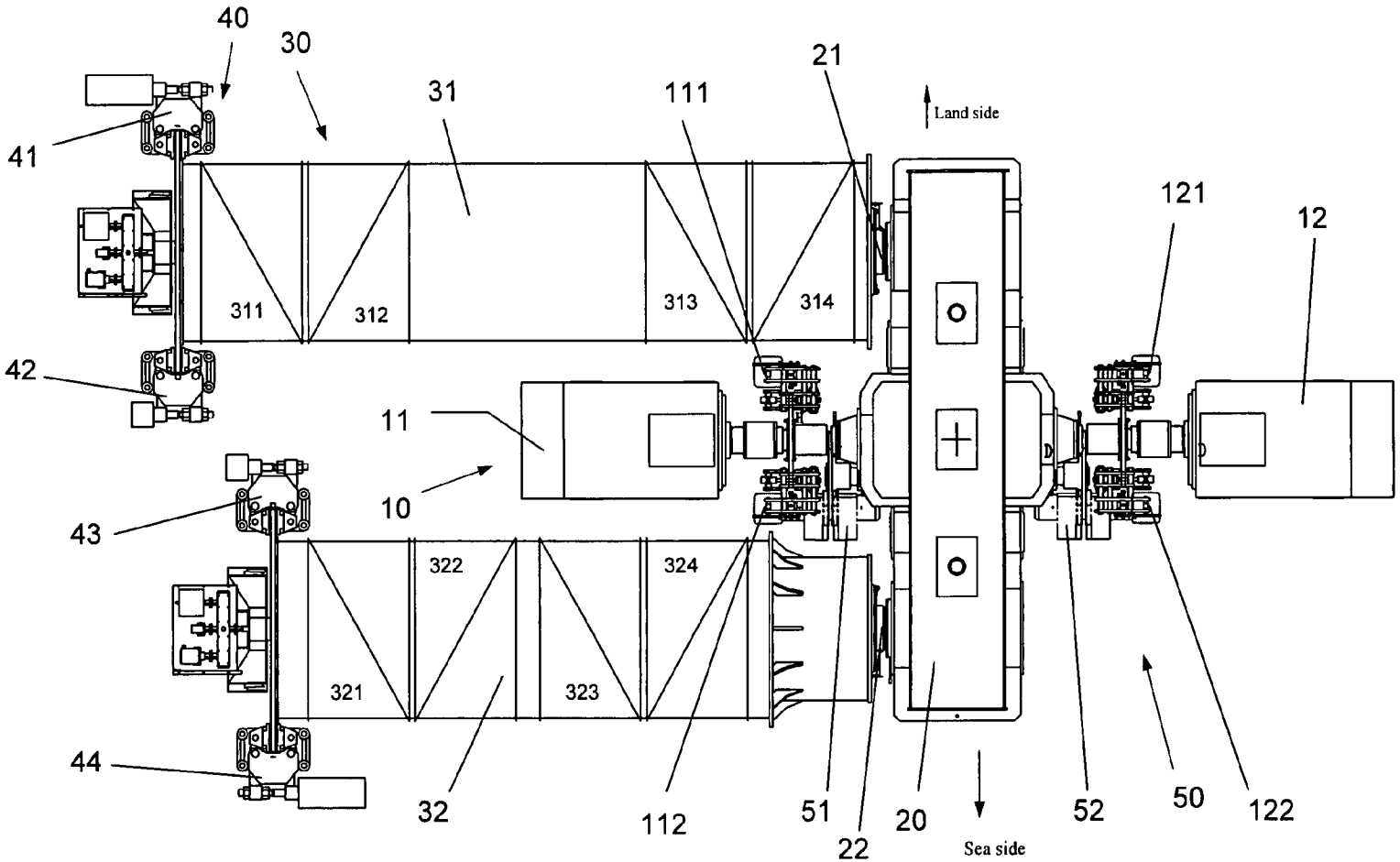
FIG. 1 is the schematic structure view of a first embodiment of the lifting machinery of two reel differential type for two 40 feet container shore crane lifting machinery with two motors according to the invention.
Figure 2:
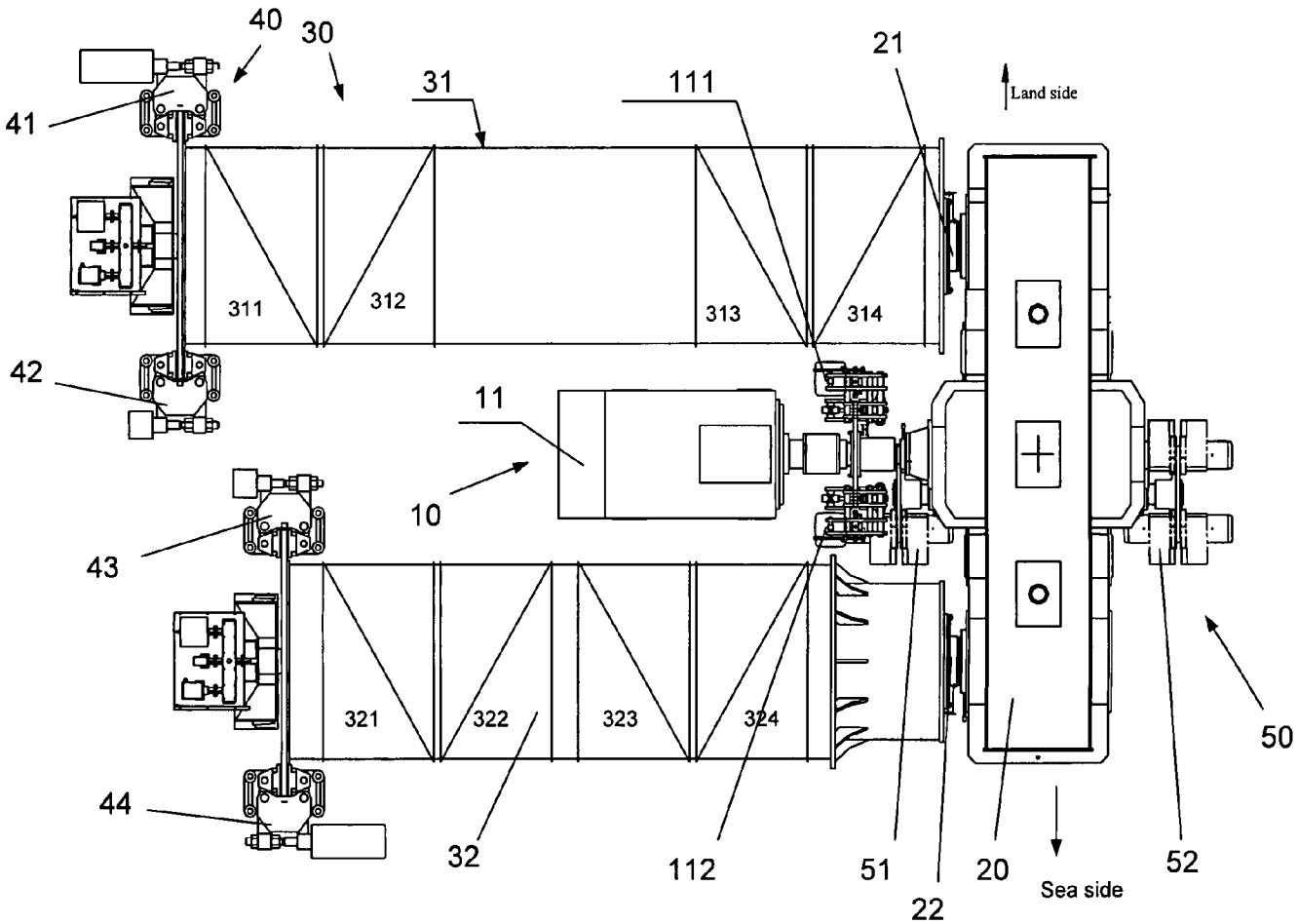
FIG. 2 is the schematic structure view of a second embodiment of the lifting machinery of two reel differential type for two 40 feet container shore crane having the crane lifting machinery with one motor according to the invention.

Referring to FIGS. 1 and 2, they are the schematic structure view of the lifting machinery of two reel differential type for two 40 feet container shore crane according to the invention. The lifting machinery of the invention includes: a motor 10, a reductor 20 connecting to the motor 10, a high speed brake 11 provided on the input end of the reductor 20, a reel 30 connecting to the output end of the reductor 20, a reel brake 40 provided on the reel 30, and a differential shaft brake 50 connecting to the reductor 20 and controlling the power distribution of the reductor 20.

Regarding the motor 10, one motor or two motors may be provided based on the motor power; according to the invention, a planetary differential reductor is used as the reductor 20, being provided at the output end of the motor 10, the planetary differential reductor 20 has a high speed input shaft, a low speed output shaft and a differential project shaft controlling the power distribution; the output shaft of the motor 10 connects to the high speed input shaft of the planetary differential reductor 20, at least one high speed brake 11 is provided on the high speed input shaft of the planetary differential reductor 20; for the reel 30, two reels are provided, one is the land side reel 31 and the other is the sea side reel 32, one of the reels 31, 32 connects to one of the low speed output shafts 21 and 22 of the planetary differential reductor 20, respectively; at least one reel brake is provided on each reel 30; the differential shaft brake 50 controls the power distribution of the planetary differential reductor 20; the differential shaft brake 50 comprises a first differential shaft brake 51 and a second differential shaft brake 52, one of the differential shaft brakes 51, 52 connects to one of the differential project shafts of the two planetary gear trains of the planetary differential reductor 20 respectively in order to control the land side hanger tool and the sea side hanger tool respectively; the revolutions of the differential project shafts of the two planetary trains of the planetary differential reductor 20 is controlled by the two differential brakes 51 and 52, then the revolutions of the land side reel and the sea side reel can be controlled simultaneously, or the revolution of the land side reel or the sea side reel may be controlled separately. Thus the synchronous control of the land side hanger tool and the sea side hanger tool or the separately control of the land side hanger tool or the sea side hanger tool can both be carried out.

Referring to FIG. 1, it is the schematic view of a first embodiment of the lifting machinery of two reels differential type for two 40 feet container shore crane according to the invention having the crane lifting machinery with two motors. The crane lifting machinery of the invention includes a motor 10, a planetary differential reductor 20, a reel 30, a reel brake 40 and a differential shaft brake 50.

According to the embodiment, two motors, a first motor 11 and a second motor 12 are provided as the motor 10. The planetary differential reductor 20 provided at the output end of motor 10 has two high speed input shafts 23 and 24, two low speed output shafts 21 and 22, and two differential project shafts controlling the power distribution.

For the two high speed input shaft 23 and 24 of said planetary differential reductor 20, the high speed input shaft 23 connects with the output shaft of the first motor 11, two high speed brakes 111 and 112 are provided on the high speed input shaft 23 of the planetary differential reductor 20; another high speed input shaft 24 connects to the output shaft of the second motor 12, two high speed brakes 121 and 122 are provided on the high speed shaft 24 of the planetary differential reductor 20.

The low speed output shaft of said planetary differential reductor 20 is used to drive the revolution of the four project rope reel; according to the embodiment, the planetary differential reductor 20 has two low speed output shafts 21 and 22, a land side four project rope reel 31 connects to the land side low speed output shaft 21, the four project ropes 311, 312, 313, 314 of the land side four project rope reel 31 connect to a hanger tool; a sea side four project rope reel 32 connects to the sea side low speed output shaft 22, the four project ropes 321, 322, 323, 324 of the sea side four project rope reel 32 connect to another hanger tool; the revolutions of two four project rope reels 31 and 32 follow the revolutions of the low speed output shafts of the planetary differential reductor 20. The reel brakes 40 controls the revolution of the four project rope reel 30 provided on said each four project rope reel 30 respectively so as to carry out the emergent braking of the land side and sea side hanger tools and the conversion from simultaneous lifting or lowering of two hanger tool to lifting or lowering of one hanger tool. According to the embodiment, two reel brakes 40 are provided on the four project rope reel 30 respectively, i.e. two reel brakes 41 and 42 are provided on land side four project rope reel 31; and two reel brakes 43 and 44 are provided on the sea side four project rope reel 32.

The differential brake 50 provided on the differential project shaft of the planetary differential reductor 20 is used to control the power distribution of the planetary differential reductor 20, according to the invention, two differential shaft, a first planetary machinery differential shaft brake 51 and a second planetary machinery differential shaft brake 52 are provided, each one of the differential shaft brakes 51 and 52 connects to one of the two differential project shafts of the planetary differential reductor 20 respectively so as to control the operation of the land side, sea side four project rope reels 30; wherein the first planetary machinery differential shaft brake 31 connects to a differential shaft of the planetary differential reductor 20, and the differential shaft is used to control the four project rope reel 31 at either side (the land side or the sea side); the second planetary machinery differential shaft brake 52 connects to another differential shaft of the planetary differential reductor 20, and the differential shaft is used to control the four project rope reel 32 at another side.

The differential shaft brake 50 controls the planetary differential reductor as follows:

If the two differential shaft brakes 51 and 52 are in brake state and all of the high speed shaft brakes 11 and the reel brakes 40 are in open state, the power is distributed to both the sea side and land side reels automatically depending on the outer twisting moment;

If one differential shaft brake in the two planetary machinery differential shaft brakes 51 and 52 is in open state and another differential shaft brake is in braking state, the power is transferred to the reel whose reel brake is in open state only while the reel of another side whose reel brake is in braking state does not receive the moment of the motor;

If the braking state and the open state of the two differential shaft brakes are interchanged each other, the power is transferred to the reel of the other side whose reel brake is in open state only and the opposite side reel whose reel brake is in braking state does not receive the moment of the motor.

Referring to FIG. 2, it is the schematic structure view of the lifting machinery of two reel differential type for two 40 feet container shore crane according to the invention. The crane lifting machinery has one motor. According to the embodiment, the crane lifting machinery consists of a motor 10, a reductor 20, a four project rope reel 30, a reel brake 40, and a differential shaft brake 50.

The different structure between the second embodiment and the first embodiment is: one motor 11 is provided only when the power of the motor is large enough, the output shaft of the motor connects to the high speed input shaft 23 of the planetary differential reductor 20, and two high speed brakes 111, 112 are provided on the high speed input shaft 23 of the planetary differential reductor 20.

As shown in FIGS. 1 and 2, the invention can carry out the synchronous operation of the two hanger tools and the operation of single hanger tool at either side.

According the invention, the differential shaft brakes 51 and 52 control the differential project shafts of the two planetary gear trains of the planetary differential brake 20 in order to control the simultaneous revolution of the land side real and the sea side reel, or the seperate revolution of the land side reel or the sea side reel so as to carry out the synchronous control of the land side hanger tool and the sea side hanger tool and the separate control of the land side hanger tool or the sea side hanger tool.

When implementing the synchronous operation of the two hanger tools:

All of the differential shaft brakes 51 and 52 are in braking state, and all of the high speed shaft brakes 111, 112 and the reel brakes 40 are in open state, the power of the motor outputs to the reels 31, 32 through the low speed output shaft of the planetary differential reductor 20 at one time so that two 40 (or 45) feet containers or one 40 (or 45) feet container and two 20 feet containers or four 20 feet containers can be lifted by the crane at one time;

When implementing the operation of single side hanger tool:

One of the differential shaft brakes 51 and 52 is in open state and the other is in braking state so that the power is transferred to the reel whose reel brake is in open state only, and the other reel of another side whose reel brake is in braking state does not receive the moment of the motor.

Based on the above description, it can be concluded that by using the planetary differential reductor having both sea and land outputs, that is, a set of motors and reductors connecting to two sets of the lifting machineries, the loading and unloading efficiency of the container shore crane is increased; further by using a planetary differential reductor and two differential shaft brakes, the revolutions of the two differential project shafts are controlled by the two differential shaft brakes, so that the operation of the individual reel can be controlled and the synchronous operation of two hanger tool or the separate operation of single hanger tool can also be carried out, meeting the requirement of the loading and unloading; in addition, since the two sets of the lifting machineries are driven by one set of the planetary differential reductor, the structure is simplified, the weight and the cost is reduced, and the maintenance is facilitated.

The invention claimed is:

1. A two-reel type lifting machinery for a container crane for lifting two 40 feet containers simultaneously, comprising:

at least one motor;

a planetary reduction gear box having at least one high speed input shaft and at least one low speed output shaft, the at least one high speed input shaft is connected to an output end of the at least one motor;

a plurality of reels, each being connected to one of the at least one low speed output shaft, each of the plurality of reels having four ropes and being connected to a spreader;

a plurality of reel brakes mounted on the plurality of reels;

a plurality of high speed brakes mounted on the at least one high speed input shaft; and a plurality of power distribution brakes mounted on the planetary reduction gear box for distributing power outputted to each of the at least one low speed output shaft.

2. The two-reel type lifting machinery of claim 1, wherein the planetary reduction gear box has first and second low speed output shafts;

the first low speed output shaft is positioned on a first side of the planetary reduction gear box, connected to a first reel of the plurality of reels, the first reel that is connected to the first low speed output shaft has four ropes connecting to a first spreader; and the second low speed output shaft is positioned on a second side of the planetary reduction gear box, connected to a second reel of the plurality of reels, the second reel that is connected to the second low speed output shaft has four ropes connecting to a second spreader.

3. The two-reel type lifting machinery of claim 1, wherein the lifting machinery has first and second motors;

an output end of the first motor is connected to a first of the at least one high speed input shaft, and first two of the plurality of high speed brakes are mounted on the first high speed input shaft; and an output end of the second motor is connected to a second of the at least one high speed input shaft, and second two of the plurality of high speed brakes are mounted on the second high speed input shaft.

4. The two-reel type lifting machinery of claim 1, wherein the lifting machinery has one motor, and the reduction gear box has one high speed input shaft; and an output end of the one motor is connected to the one high speed input shaft, and two of the plurality of high speed brakes are mounted on the one high speed input shaft.

5. The two-reel type lifting machinery of claim 1, wherein two of the plurality of reel brakes are mounted on each of the plurality of reels.

6. The two-reel type lifting machinery of claim 1, wherein the lifting machinery has first and second power distribution brakes, and the planetary reduction gear box has a plurality of low speed output shafts being divided into a first side and a second side;

the first power distribution brake is connected to the plurality of low speed output shafts of the first side, and a second power distribution brake is connected to the plurality of low speed output shafts of the second side; and if both the first power distribution brake and the second power distribution brake are braked, the plurality of low speed output shafts of both the first and second sides are powered by the planetary reduction gear box; if the first power distribution brake is braked while the second power distribution brake is open, then the plurality of low speed output shafts of the first side are powered by the planetary reduction gear box, and the plurality of low speed output shafts of the second side are unpowered; if the second power distribution brake is braked while the first power distribution brake is open, then the plurality of low speed output shafts of the second side are powered by the planetary reduction gear box, and the plurality of low speed output shafts of the first side are unpowered.

* * * * *